US010490145B2

(12) United States Patent
Zhu et al.

(10) Patent No.: US 10,490,145 B2
(45) Date of Patent: Nov. 26, 2019

(54) APPARATUS FOR ENHANCING BRIGHTNESS UNIFORMITY OF DISPLAYED IMAGE, DISPLAY APPARATUS, AND METHOD FOR DISPLAYING IMAGE

(71) Applicants: BOE TECHNOLOGY GROUP CO., LTD., Beijing (CN); Beijing BOE Special Display Technology Co., Ltd., Beijing (CN)

(72) Inventors: Huizhong Zhu, Beijing (CN); Junguo Liu, Beijing (CN); Shenglin Sun, Beijing (CN)

(73) Assignees: BOE TECHNOLOGY GROUP CO., LTD., Beijing (CN); Beijing BOE Special Display Technology Co., Ltd., Beijing (CN)

( * ) Notice: Subject to any disclaimer, the term of this patent is extended or adjusted under 35 U.S.C. 154(b) by 40 days.

(21) Appl. No.: 15/571,615

(22) PCT Filed: Jun. 2, 2017

(86) PCT No.: PCT/CN2017/086943
§ 371 (c)(1),
(2) Date: Nov. 3, 2017

(87) PCT Pub. No.: WO2018/054093
PCT Pub. Date: Mar. 29, 2018

(65) Prior Publication Data

US 2019/0130853 A1 May 2, 2019

(30) Foreign Application Priority Data

Sep. 21, 2016 (CN) ..... 2016 1 0839774

(51) Int. Cl.
*G09G 3/36* (2006.01)

(52) U.S. Cl.
CPC ..... *G09G 3/3607* (2013.01); *G09G 3/36* (2013.01); *G09G 2320/0233* (2013.01);
(Continued)

(58) Field of Classification Search
CPC ..... G09G 3/2022; G09G 2320/0276; G09G 2360/16
See application file for complete search history.

(56) References Cited

U.S. PATENT DOCUMENTS

2004/0160392 A1* 8/2004 Kim ..... G09G 3/2022 345/63
2006/0232601 A1 10/2006 Kimura et al.
(Continued)

FOREIGN PATENT DOCUMENTS

CN 1848220 A 10/2006
CN 101777314 A 7/2010
CN 103247259 A 8/2013

OTHER PUBLICATIONS

International Search Report & Written Opinion dated Sep. 2, 2017, regarding PCT/CN2017/086943.

*Primary Examiner* — Chun-Nan Lin
(74) *Attorney, Agent, or Firm* — Intellectual Valley Law, P.C.

(57) ABSTRACT

The present application discloses a method for displaying image using a display panel. The method includes receiving a frame of image data, which is divided into a first portion and a second portion based on that each sub-pixel in the first portion has an initial grayscale value smaller than that of each subpixel in the second portion. The method includes converting the frame of image data into N frames of image data. Each sub-pixel in the first portion is provided with a first grayscale value in K of the N frames and a second grayscale value in N-K of the N frames, and each sub-pixel in the second portion is retained with its initial grayscale
(Continued)

value. N is no smaller than 2 and K varies from 1 to N−1. The method includes displaying each of the N frames of images respectively based on the N frames of image data according to a frame refreshing frequency.

20 Claims, 4 Drawing Sheets

(52) U.S. Cl.
CPC ..... *G09G 2320/0271* (2013.01); *G09G 2320/0276* (2013.01); *G09G 2360/147* (2013.01)

(56) References Cited

U.S. PATENT DOCUMENTS

2009/0289968 A1* 11/2009 Yoshida ..... G09G 3/2025 345/691
2013/0201223 A1* 8/2013 Li ..... G09G 3/2022 345/690
2013/0321480 A1* 12/2013 Kim ..... G09G 3/2022 345/690

* cited by examiner

APPARATUS FOR ENHANCING BRIGHTNESS UNIFORMITY OF DISPLAYED IMAGE, DISPLAY APPARATUS, AND METHOD FOR DISPLAYING IMAGE

CROSS-REFERENCE TO RELATED APPLICATION

This application is a national stage application under 35 U.S.C. § 371 of International Application No. PCT/CN2017/086943, filed Jun. 02, 2017, which claims priority to Chinese Patent Application No. 201610839774.2, filed Sep. 21, 2016, the contents of which are incorporated by reference in the entirety.

TECHNICAL FIELD

The present invention relates to display technology, particularly, to an apparatus for enhancing brightness uniformity of a displayed image, a display apparatus having the same, and a method for displaying image.

BACKGROUND

Liquid crystal display (LCD) panel has found a wide variety of applications. Typically, a liquid crystal display panel includes a counter substrate and an array substrate facing each other. Thin film transistors, gate lines, data lines, pixel electrodes, common electrodes, and common electrode signal lines are disposed on the array substrate and counter substrate. Between the two substrates, a liquid crystal material is injected to form a liquid crystal layer.

SUMMARY

In one aspect, the present invention provides an apparatus for enhancing brightness uniformity of displayed image, comprising a data receiver configured to receive a frame of image data comprising a plurality of sub-pixels respectively having a plurality of initial grayscale values; a processor configured to convert the frame of image data, which is divided into a first portion and a second portion based on that each sub-pixel in the first portion has an initial grayscale value smaller than that of each subpixel in the second portion, into N frames of image data; wherein each sub-pixel in the first portion is provided with a first grayscale value in K of the N frames of image data and a second grayscale value in N-K of the N frames of image data; and each sub-pixel in the second portion is retained with its initial grayscale value in each of the N frames of image data, wherein N is an integer no smaller than 2 and K varies from 1 to N−1.

Optionally, the apparatus further comprises a display panel configured to display a frame of image based on each of the N frames of image data according to a frame refreshing frequency.

Optionally, the display panel is configured to provide a grayscale image based on each of the plurality of initial grayscale values that is smaller than the threshold voltage value, a maximum brightness value of the grayscale image being measured by a camera; and the processor is configured to deduce a set of gamma curve data comprising a set of gamma-corrected brightness values corresponding to a set of grayscale values, the first grayscale value and the second grayscale value being two adjacent grayscale values corresponding to two gamma-corrected brightness values in the set of gamma curve data.

Optionally, the processor is configured to select the first grayscale value, the second grayscale value, and a value of K so that a difference between a modified brightness value for sub-pixels in the first portion having a particular initial grayscale value and a superposition value of the two gamma-corrected brightness values respectively weighted with a first ratio of K/N and a second ratio of (N-K)/N is minimal.

Optionally, the modified brightness value is equal to a maximum value among all sub-pixels corresponding to the particular initial grayscale value, multiplied by a factor.

Optionally, the processor is configured to select a first value smaller than 1 as the factor to obtain a first value of the modified brightness value used in a first iteration of converting the frame of image data to the N frames of image data; and the display panel is configured to display a frame of image based on each of the N frames of image data which is subjected to a determination whether a brightness uniformity of the displayed frame of image meets a threshold uniformity.

Optionally, the processor is configured to select a second value larger than the first value but still smaller than 1 as the factor to obtain a second value of the modified brightness value used in a second iteration of converting the frame of image data to the N frames of image data until the brightness uniformity of the displayed frame of image based on each of the N frames of images meets the threshold uniformity; and determine that the second value of the modified brightness value to be corresponding to the particular initial grayscale value.

Optionally, N is selected to be equal to or smaller than 4.

Optionally, the frame refreshing frequency is N×60 Hz.

In another aspect, the present invention provides a display apparatus comprising the apparatus for enhancing brightness uniformity of displayed image described herein.

In another aspect, the present invention provides a method for displaying image using a display panel, the method comprising receiving a frame of image data comprising a plurality of sub-pixels respectively having a plurality of initial grayscale values; and converting the frame of image data, which is divided into a first portion and a second portion based on that each sub-pixel in the first portion has an initial grayscale value smaller than that of each subpixel in the second portion, into N frames of image data; wherein each sub-pixel in the first portion is provided with a first grayscale value in K of the N frames of image data and a second grayscale value in N-K of the N frames of image data; and each sub-pixel in the second portion is retained with its initial grayscale value in each of the N frames of image data, wherein N is an integer no smaller than 2 and K varies from 1 to N−1.

Optionally, the method further comprises displaying each of the N frames of images respectively based on the N frames of image data according to a frame refreshing frequency.

Optionally, the method comprises displaying a grayscale image of each of the initial grayscale values that are smaller than the threshold grayscale value to measure a corresponding maximum brightness value and to deduce a set of gamma curve data comprising a set of gamma-corrected brightness values corresponding to a set of grayscale values.

Optionally, the first grayscale value and the second grayscale value are two adjacent grayscale values corresponding to two gamma-corrected brightness values in the set of gamma curve data.

Optionally, the first grayscale value, the second grayscale value, and a value of K are selected so that a difference between a modified brightness value for all sub-pixels in the first portion having a particular initial grayscale value and a superposition value of the two gamma-corrected brightness values respectively weighted with a first ratio of K/N and a second ratio of (N-K)/N is minimal.

Optionally, converting the frame of image data comprises determining the modified brightness value to be equal to a maximum brightness value among all sub-pixels corresponding to the particular initial grayscale value multiplied by a factor.

Optionally, converting the frame of image data further comprises selecting the factor smaller than 1 to calculate a first value of the modified brightness value used in a first iteration of converting the frame of image data to the N frames of image data; displaying an image based on each of the N frames of image data; and determining whether a brightness uniformity of the displayed image meets a threshold uniformity.

Optionally, converting the frame of image data further comprises increasing the factor to calculate a second value of the modified brightness value used in a second iteration of converting the frame of image data to the N frames of image data until the brightness uniformity of the displayed image based on each of the N frames of images meets the threshold uniformity; and determining that the second value of the modified brightness value to be corresponding to the particular initial grayscale value.

Optionally, N is selected to be equal to or smaller than 4.

Optionally, the frame refreshing frequency is N×60 Hz.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Typically, the LCD panel includes a display region and a peripheral region surrounding the display region. The display region selectively allows light to pass under a control of electrical field thereof to achieve image display. The peripheral region does not allow light to pass and is mainly used to lay peripheral electrical circuits and apply sealing material around the frame to seal the liquid crystal material in the display area.

A general drawback of the LCD display panel is its brightness non-uniformity in the displayed images in regions having relatively low brightness. In these regions, the displayed images do not truly reflect information of original field images, potentially misleading a user especially for medical and military applications.

Figure 1:
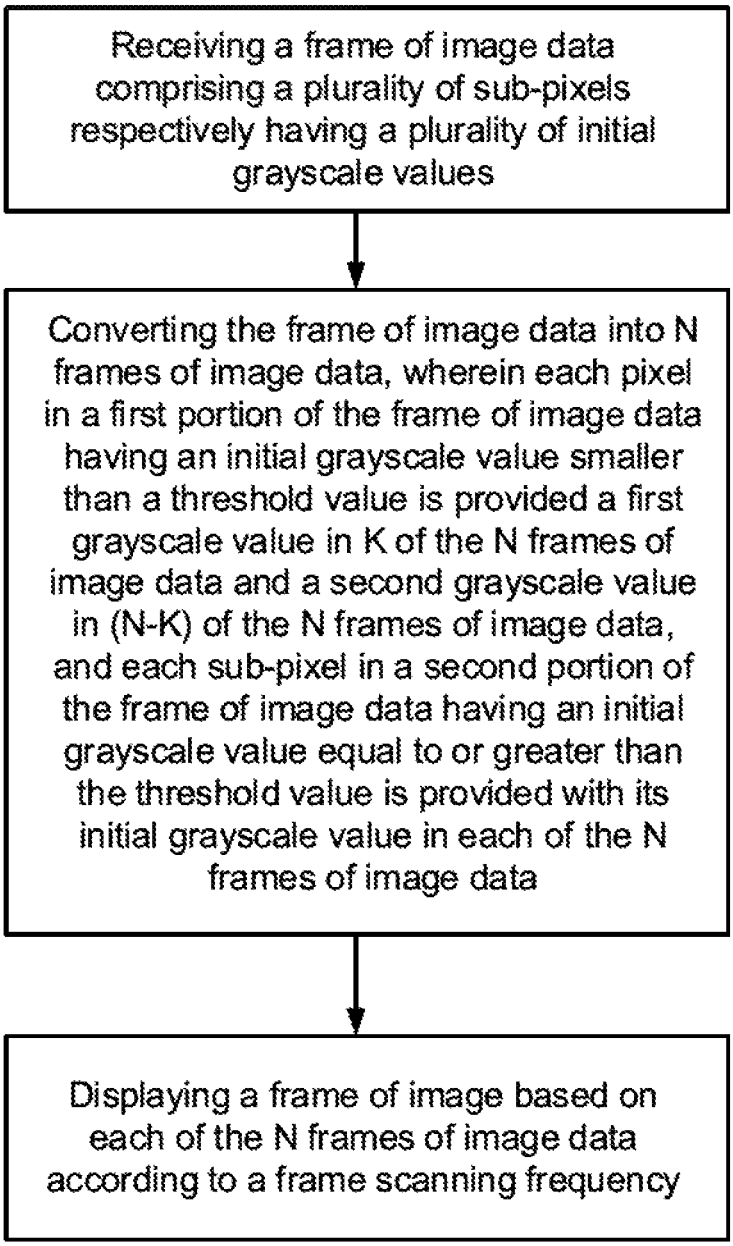
FIG. 1 is a flow chart illustrating a method of displaying image on a display panel according to some embodiments of the present disclosure.

Accordingly, the present invention provides, inter alia, an apparatus for enhancing brightness uniformity for a displayed image, a display apparatus having the same, and a method for displaying image that substantially obviate one or more of the problems due to limitations and disadvantages of the related art. In one aspect, the present disclosure provides a method of displaying image on a display panel. FIG. 1 shows a flow chart illustrating a method of displaying image on a display panel according to some embodiments of the present disclosure. Referring to FIG. 1, the method of displaying image includes receiving initial image data, e.g., a frame of image data comprising a plurality of sub-pixels respectively having a plurality of initial grayscale values. Each frame of initial image data includes a plurality of sub-pixels corresponding respectively to a plurality of initial grayscale values. For each frame of image data, it includes a first portion including multiple subpixels having initial grayscale values smaller than a threshold grayscale value and a second portion including multiple subpixels having initial grayscale values equal to or greater than the threshold grayscale value. Additionally, the method of displaying image includes converting the frame of image data into N frames of image data such that each sub-pixel in the first portion is provided with a first grayscale value in K of the N frames of image data and a second grayscale value in N-K of the N frames of image data, and each sub-pixel in the second portion is retained with its initial grayscale value in each of the N frames of image data. Here, N is an integer no smaller than 2 and K varies from 1 to N−1. Optionally, the method further includes displaying a frame of image based on each of the N frames of image data according to a frame refreshing frequency. The frame refreshing frequency may be chosen to, be N times of a nominal frame refreshing frequency.

In some embodiments, for each frame of image data, converting the frame of image data to the N frames of image data is based on a grayscale correspondence relationship between the initial grayscale values and one or more converted grayscale values. Optionally, for any one initial grayscale value in the first portion that is smaller than the threshold grayscale value, the one initial grayscale value is converted to a first grayscale value in K frames of the N frames of image data and a second grayscale value in remaining (N-K) frames of the N frames of image data. For any initial grayscale value in the second portion that is equal to or larger than the threshold grayscale value, it retains its initial grayscale value in each of the N frames of image data. In other words, the correspondence relationship for grayscale value conversion for the first portion of initial grayscale values is expressed as that the one initial grayscale value corresponds to K numbers of first grayscale value and (N-K) numbers of second grayscale values. The grayscale value conversion is only utilized in the first portion for enhancing uniformity of image in regions with relatively low brightness that is most sensitive to human eyes. Here, N is an artificially selected integer number. For example N=4. K simply varies from 1 to N−1.

After the grayscale value conversion, a new image based on each of the N frames of image data according to an appropriate frame refreshing frequency is displayed. Utilizing the visual suspension effect of the human eye, the N frames of image data are scanned with a frame refreshing frequency of N times of a nominal frame refreshing frequency to produce N frames of images with more finely divided brightness levels that are indistinguishable by human eyes. The brightness uniformity of the images displayed using this method is substantially enhanced for sub-pixels with relative low brightness values. The enhanced image is able to capture true field image information more accurately.

Figure 2:
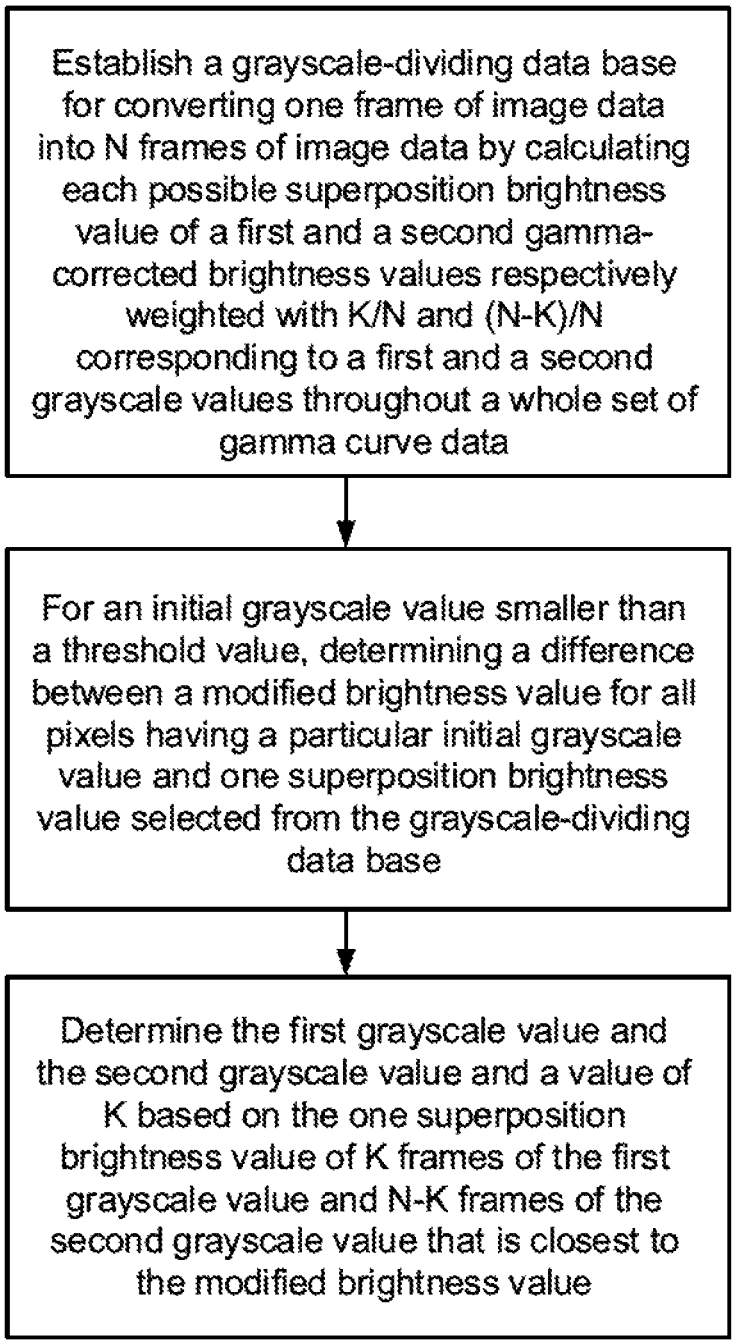
FIG. 2 is a flow chart illustrating a method of converting a frame of image into N frames of image for selected sub-pixels according to some embodiments of the present disclosure.

In some embodiments, for specifically determining the first grayscale level, the second grayscale level, and a value of K (under a certain selected value of N) that satisfies the grayscale correspondence relationship, the present disclosure shows a method as illustrated in FIG. 2 below.

FIG. 2 is a flow chart illustrating a method of converting a frame of image into N frames of image for selected sub-pixels according to some embodiments of the present disclosure. This chart is merely an example. Other variations and modifications are possibly applicable to obtain the same or similar grayscale correspondence relationship between an initial grayscale value and one or more converted grayscale values.

Referring to FIG. 2, the method includes establishing a so-called grayscale-dividing data base. For any display panel, there exists a set of gamma curve data which characterizes how the display panel produce a certain gamma-corrected brightness value out of a certain grayscale value. Optionally, the set of gamma curve data can be deduced by measuring a digitized brightness value using a charge-coupled device (CCD) camera from a corresponding displayed grayscale image based on every grayscale value. The measured digital brightness value is a gamma-corrected brightness value that inherently includes the gamma corrected luminance out of a certain input image data in terms of voltage or current per sub-pixel. Based on the gamma curve data, the grayscale-dividing data base can be established for a plan of converting one frame of image data into N frames of image data. In particular, one brightness value Ixy(K) of the grayscale-dividing data base corresponds to two gamma-corrected brightness values Ix(K) and Iy(K) of the gamma curve data respectively corresponding to two grayscale values in a following formula:

$$Ixy(K) = Ix \cdot \frac{K}{N} + Iy \cdot \frac{N-K}{N} \quad (K = 1, 2, \ldots, N-1); \tag{1}$$

where Ix represents a gamma-corrected brightness value corresponding to a grayscale value of x in the gamma curve data; Iy is a gamma-corrected brightness value corresponding to a grayscale value of y in the gamma curve data; and Ixy(K) represents a superposition brightness value of K frames of image of grayscale value x and N-K frames of image of grayscale value y. In an embodiment, the grayscale value x and the grayscale value y are any two adjacent grayscale values. For example, x=5, and y=6. Optionally, the grayscale value x and the grayscale value y are not adjacent but two grayscale values very close to each other. In general, for each pair of grayscale values x and y, a set of K brightness values Ixy(K) can be correspondingly generated using the formula (1) to be included as part of the grayscale-dividing data base. Note, this grayscale-dividing data base is generated only necessarily for those initial grayscale values smaller than a threshold grayscale value as the method is intended to enhance image uniformity of images at relative low-brightness region with smaller grayscale values. Typically the threshold grayscale value is selected to be 17. In other words, the image data conversion mentioned above only is executed for grayscale values from 0 to 16. Optionally, threshold grayscale value can be larger than 17 in various applications. H man eyes are not sensitive to the brightness non-uniformity in the displayed image with higher brightness produced by image data with grayscale values of 17 and above. Increasing the threshold value merely increase volume of data processing without effectively enhancing the low-brightness uniformity of the image.

The threshold grayscale value may be any appropriate value. Optionally, the threshold grayscale value is a value in a range of approximately 5 to approximately 30, e.g., approximately 10 to approximately 30, approximately 10 to approximately 25, approximately 15 to approximately 20, and so on. Optionally, the threshold grayscale value is 15, 16, 17, 18, 19, or 20.

Referring to FIG. 2, the method further includes, for an initial grayscale value smaller than a threshold value, determining a difference between a modified brightness value for all sub-pixels having a same initial grayscale value and one superposition brightness value particularly selected from the grayscale-dividing data base. The one superposition brightness value is one of a plurality of brightness values Ixy(K) in the grayscale-dividing data base. The modified brightness value is related to a maximum initial brightness value corresponding to a corresponding initial grayscale value. During the process of obtaining the set of gamma curve data based on a grayscale image for each initial grayscale value in the initial frame of image data, the charge-coupled device (CCD) camera is also used to record a maximum initial brightness value at a sub-pixel of the grayscale image for each grayscale value that is smaller than the threshold grayscale value. Because of brightness non-uniformity for each grayscale value, multiple sub-pixels having a same initial grayscale value may produce different initial brightness values. The modified brightness value is selected as a parameter for performing an iterated operation of converting the initial frame of image data to various possible and eventually optimized N frames of image data (particularly for initial grayscale values smaller than the threshold grayscale value) for enhancing the image uniformity for each grayscale value. In each iterated operation, once a modified brightness value is selected, in a method to be disclosed in FIG. 3 below, it can be compared with all brightness values in the grayscale-dividing data base so that the one superposition brightness value can be determined if it is the closest to the modified brightness value.

Referring to FIG. 2 again, the method includes determining the first grayscale value and the second grayscale value and a value of K based on the one superposition brightness value Ixy(K) that is the closest to the currently selected modified brightness value. Based on the formula (1), Ixy(K) is generated from gamma-corrected brightness values of K frames of the first grayscale value and N-K frames of the second grayscale value respectively with weights K/N and (N-K)/N for each initial grayscale value smaller than the threshold value. Therefore, once the superposition brightness value Ixy(K) is determined, the first grayscale value, the second grayscale value, and a value of K can be deduced to obtain the grayscale correspondence relationship mentioned earlier.

Figure 3:
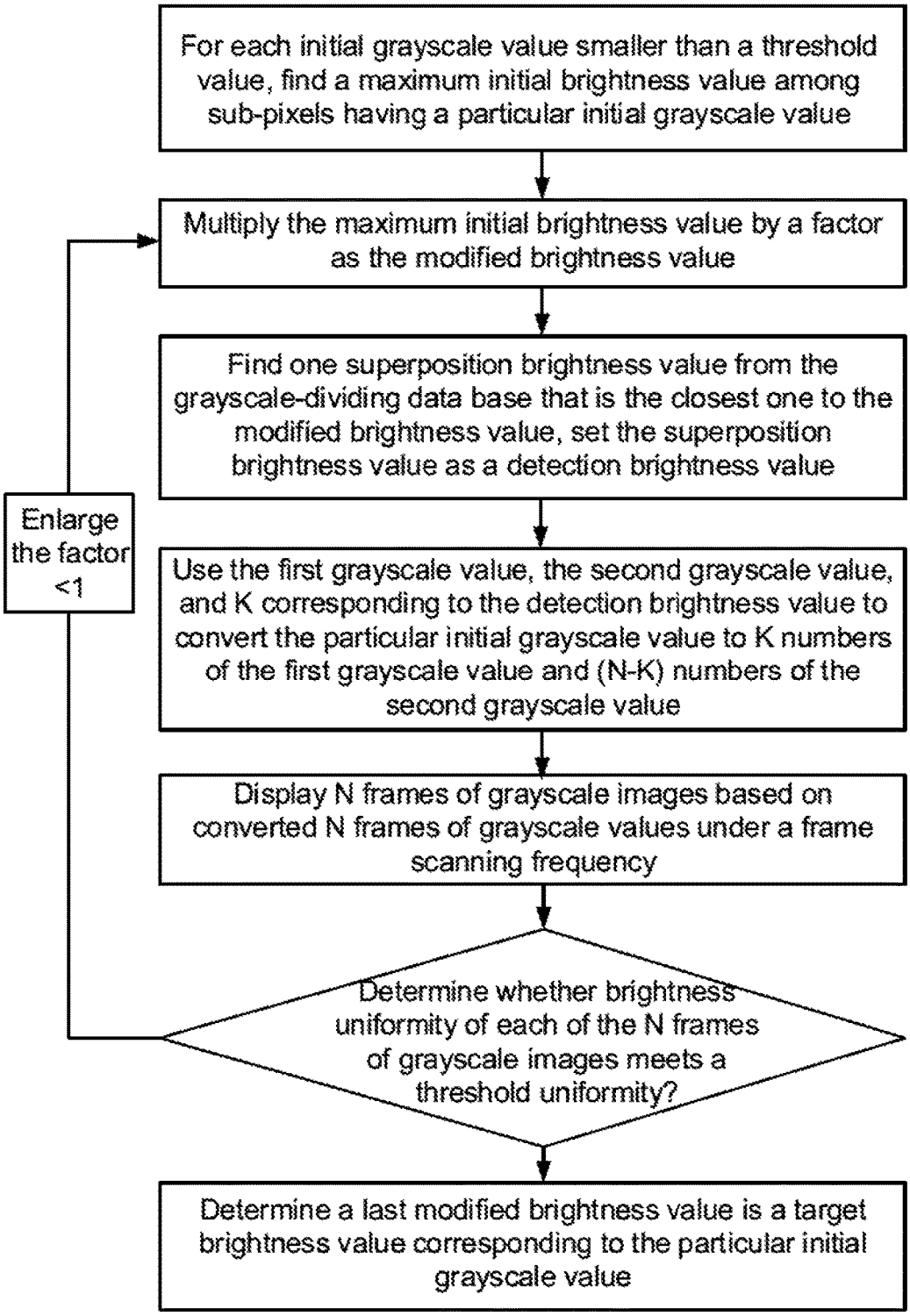
FIG. 3 is a flow chart illustrating a method of enhancing brightness uniformity of displayed image according to some embodiments of the present disclosure.

FIG. 3 is a flow chart illustrating a method of enhancing brightness uniformity of displayed image according to some embodiments of the present disclosure. In some embodiments, the method is to select a modified brightness value for each iteration operation of determining a grayscale correspondence relationship for converting one initial frame of image data into N frames of image data to enhance image brightness uniformity of the grayscale value. This method firstly includes, for each initial grayscale value smaller than the threshold value, finding a maximum initial brightness value among sub-pixels with different initial brightness values having the same initial grayscale value. Then, the modified brightness value is obtained by multiplying the maximum initial brightness value by a factor. Optionally, this factor is selected to be a constant smaller than 1 with an intention to reduce image brightness non-uniformity of smaller grayscale value. The modified brightness value then is used as a parameter (having a first value) to perform an iteration operation of converting one particular initial grayscale value to K numbers of first grayscale value and N−K numbers of second grayscale value in total N numbers of frames.

Referring to FIG. 3, the method further includes finding one superposition brightness value from the grayscale-dividing data base that is closest to the modified brightness value. The just-found superposition brightness value is used as a detection brightness value corresponding to the particular initial brightness value. The superposition brightness value in the grayscale-dividing data base has been shown in formula (1) to be associated with a first grayscale value, a second grayscale value, and a value of K under the choice of N.

Based on the detection brightness value, the first grayscale value, the second grayscale value, and the value of K can be deduced. Then, the method includes using the first grayscale value, the second grayscale value, and K value to convert the particular initial grayscale value to the first grayscale value in K of the N frames and the second grayscale value in (N-K) of the N frames. This grayscale conversion or grayscale dividing will be done for every sub-pixel with initial grayscale value smaller than the threshold value. Optionally, for every sub-pixel with initial grayscale value equal to or larger than the threshold value, the conversion is to directly copy its initial grayscale value to each of the N frames.

Referring to FIG. 3, the method further includes displaying each frame of grayscale image per each grayscale value after the grayscale conversion. The each frame of grayscale image is subjected to a brightness uniformity test to determine if certain threshold uniformity is met. If the brightness uniformity is not satisfactory, the method includes a step of increasing the factor (optionally still keeping it smaller than 1) to multiply the maximum initial brightness value to set a second value for the modified brightness value. The method includes executing an iteration operation to repeat the above steps including finding one superposition brightness value as a new detection brightness value, performing a new grayscale conversion, and displaying a new frame of grayscale image based on each of the N new frames newly converted grayscale values. The iteration operation continues until the brightness uniformity of each grayscale image meets the threshold uniformity. Then the last modified brightness value is determined to be a target brightness value corresponding to the particular initial grayscale value.

In general, the image brightness uniformity is relatively poorer at lower brightness region. Optionally, for implementing the method, the threshold grayscale value is selected to be 17. In other words, the grayscale conversion is mainly performed for initial grayscale values in a range of 0 to 16. Optionally, a specific implementation of the method can set the threshold grayscale value greater than 17. Human eyes are not sensitive to non-uniformity of high-brightness image. Larger threshold value would require larger volume of data processing load.

Because of vision suspension effect of human eyes, when a displayed image disappears, human eyes can still keep the image for a period of time. Optionally, in an implementation of the method disclosed herein, the displayed image based on each of the N frames of image data with a frame refreshing frequency of N×60 Hz to keep the display effect of the image after one frame of image data is converted into N frames of image data.

In the implementation of the method, a larger N means a higher frame refreshing frequency is needed for generating every new frame of image data to preserve the display effect of the image. Higher frame refreshing frequency demands more advanced display technology for the display panel. Optionally, N is less than or equal to 4.

Optionally, the factor used in a first iteration of converting the frame of image data into N frames of image data is selected to be 0.8. Of course other value is possible.

An example of implementing the method of displaying a grayscale image on a display panel is shown below. The method includes establishing a grayscale correspondence relationship for the display panel to perform image data conversion and display a grayscale image based on each of the N converted frames of image data. The method includes the following steps executed for a specific initial grayscale value:

1). A data receiver receives a frame of image data and a display panel displays a grayscale image based on at least the frame of image data having a plurality of initial grayscale values at respective a plurality of sub-pixels. An image collector CCD camera is used to obtain an initial brightness value of the grayscale image based on each initial grayscale value to generate a set of gamma curve data. At the same time, for each initial grayscale value that is smaller than a threshold grayscale value, a maximum initial brightness value of all sub-pixels having the same initial grayscale value is measured. For example, a first maximum initial brightness value is obtained for all sub-pixels associated with an initial grayscale value of 0, a second maximum initial brightness value is obtained for all sub-pixels associated with an initial grayscale value of 1, and so on for the initial grayscale value of 16, assuming that the threshold grayscale value is 17.

2). A grayscale-dividing data base is established based on the set of gamma curve data associated with the display panel. In particular, each brightness value Ixy(K) of the grayscale-dividing data base is equal to a superposition brightness value of a first brightness value Ix corresponding to a first grayscale value x and a second brightness value Iy corresponding to a second grayscale value y of the gamma curve data respectively weighted by K/N and (N-K)/N as shown in the formula (1). Optionally, the first grayscale value and the second grayscale value are two adjacent grayscale values in the gamma curve data. Optionally, the first grayscale value and the second grayscale value are next nearest neighbors, or other possible arrangements relative to each other.

For example, in the gamma curve data a first brightness value 1 corresponds to the first grayscale value 5 and a second brightness value 2 corresponds to the second grayscale value 6. If N=4, the grayscale-dividing data base at least includes following data:

| K | Frames for grayscale 5 | Frames for grayscale 6 | Superposition Brightness |
|---|---|---|---|
| 1 | 1 | 3 | $I56(1) = \frac{1}{4} + \frac{2\times3}{4} = 1.75$ |
| 2 | 2 | 2 | $I56(2) = \frac{1}{4} + \frac{2\times3}{4} = 1.50$ |
| 3 | 3 | 1 | $I56(3) = \frac{1}{4} + \frac{2\times3}{4} = 1.25$ |

3). For each grayscale image based on an initial grayscale value smaller than the threshold grayscale value, a modified brightness value is selected as the maximum initial brightness value among the sub-pixels having the same initial grayscale value (obtained in step 1) multiplied by a factor. Optionally, the factor is a positive constant smaller than 1 (e.g., 0.8).

4). The grayscale-dividing data base is searched through to find a supposition brightness value Ixy(K) (referred in step 2) that is closest to the modified brightness value (selected in step 3). The superposition brightness value is used as a detection brightness value corresponding to the initial grayscale value referred in step 1) and step 3).

5). The detection brightness value, which is just the superposition brightness value Ixy(K) corresponding to a grayscale image of K frames of the first grayscale value x and (N−K) frames of the second grayscale value y, is then used to establish a grayscale correspondence relationship between each initial grayscale value and K numbers of a corresponding first grayscale value and (N-K) numbers of a corresponding second grayscale value.

6). By applying the grayscale correspondence relationship for the initial grayscale value that is smaller than the threshold value, a grayscale image data corresponding to one frame of the initial grayscale value is converted to K frames of grayscale image data with the first grayscale value and (N-K) frames of grayscale image data with the second grayscale value.

7). For all initial grayscale values in a full frame of image, step 1) to 7) can be performed for those initial grayscale values smaller than the threshold grayscale value while no changes is applied to those initial grayscale values equal to or greater than the threshold grayscale value for completing the conversion of a full frame of image data. A detection display panel is used as the display panel for displaying N frames of grayscale image per each grayscale value that is smaller than the threshold grayscale value, including K frames of grayscale image of the first grayscale value and (N-K) frames of grayscale image of the second grayscale value. All the N frames of grayscale image are displayed according to a frame refreshing frequency equal to N×60 Hz to take advantage of vision suspension of human eyes. The brightness uniformity of each of the N frames of grayscale image is tested to determine whether a threshold uniformity is met.

8). If the threshold uniformity is not met, the factor that is used to multiply the maximum initial brightness value is increased to another constant (optionally still smaller than 1, e.g., 0.9) to set a second value for the modified brightness value. Then, the method is reiterated from the step 4) to the step 8) for each grayscale value until the threshold uniformity is met.

9). The last value of the modified brightness value after the threshold uniformity is met is determined to be the target brightness value corresponding to the initial grayscale value.

For example, for grayscale value of 0, the factor is selected to be 0.8, the grayscale value of 0 is converted accordingly. The resulting grayscale image after the conversion yields a brightness uniformity for the grayscale value of 0 that may be determined to have met a threshold uniformity in just one iteration operation. Then the target brightness value for the grayscale value of 0 is just the modified brightness value equal to the maximum initial brightness value multiplied by 0.8. The iteration is done for the grayscale value of 0. While, for grayscale value of 1 and the factor firstly is also selected to be 0.8, but the threshold uniformity for the grayscale value of 1 is not met in a resulting grayscale image after the conversion in the first iteration operation. Then the factor can be increased to 0.9 to start a second iteration operation, and may be repeated in more iteration operations until the brightness uniformity for the grayscale value of 1 meets the threshold uniformity. Then the target brightness value corresponding to the grayscale value of 1 is just the last modified brightness value equal to the maximum initial brightness value multiplied by the last factor.

Figure 4:
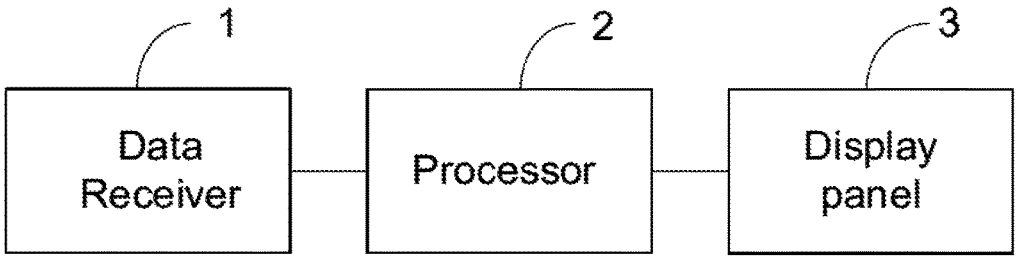
FIG. 4 is a block diagram of an apparatus for enhancing brightness uniformity of displayed image according to some embodiments of the present disclosure.

In another aspect, the present disclosure provides an apparatus for enhancing brightness uniformity of a displayed image. FIG. 4 is a block diagram of an apparatus for enhancing brightness uniformity of displayed image according to some embodiments of the present disclosure. Referring to FIG. 4, the apparatus includes a data receiver 1 configured to receive a frame of image data comprising a plurality of sub-pixels respectively having a plurality of initial grayscale values. The apparatus also includes a processor 2 configured to convert the frame of image data, which comprises a first portion containing initial grayscale values smaller than a threshold grayscale value and a second portion containing initial grayscale values equal to or greater than the threshold grayscale value, into N frames of image data. Each sub-pixel in the first portion is provided with a first grayscale value in K of the N frames of image data and a second grayscale value in N-K of the N frames of image data, and each sub-pixel in the second portion is retained with its initial grayscale value in each of the N frames of image data. N is an integer no smaller than 2 and K varies from 1 to N-1. For example, N is no greater than 4 and the threshold grayscale value is 17.

In some embodiments, the apparatus further includes a display panel 3 configured to display a frame of image based on each of the N frames of image data according to a frame refreshing frequency, e.g., N×60 Hz.

Optionally, the first grayscale value and the second grayscale value referred to above are two adjacent grayscale values corresponding to two gamma-corrected brightness values in a set of gamma curve data of the display panel, although other pair of grayscale values other than two adjacent ones can be possible alternatives.

Optionally, the processor 2 is configured to select the first grayscale value, the second grayscale value, and a value of K so that a difference between a modified brightness value for sub-pixels in the first portion having a same initial grayscale value and a superposition value of the two gamma-corrected brightness values respectively weighted with a first ratio of K/N and a second ratio of (N-K)/N is minimal.

Optionally, the modified brightness value is equal to a maximum brightness value among all sub-pixels corresponding to the same initial grayscale value, multiplied by a factor of a constant smaller than 1 and greater than zero.

Optionally, the processor 2 is configured to select a first value smaller than 1 and greater than zero as the factor and to perform a first iteration of converting the frame of image data to the N frames of image data. The display panel 3 is configured to display a frame of image based on each of the N frames of image data which is subjected to a determination whether a brightness uniformity of the same grayscale value meets a threshold uniformity.

Optionally, the processor 2 is configured to select a second value larger than the first value but still smaller than 1 as the factor and to perform a second iteration of converting the frame of image data to the N frames of image data until the brightness uniformity of the same grayscale value based on each of the N frames of images meets the threshold uniformity to determine that the last modified brightness value corresponds to the particular initial grayscale value.

In yet another aspect, the present disclosure provides a display apparatus including the apparatus for enhancing brightness uniformity of a displayed image described herein. The display apparatus can one of the following products, but not limited to, including smart phone, tablet computer, television, flat panel display, notebook computer, digital frame, navigator, and any product containing an image display function.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defmed by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defmed by the following claims. Moreover, no element and component in the present disclosure is intended to be dedicated to the public regardless of whether the element or component is explicitly recited in the following claims.

What is claimed is:

1. An apparatus for enhancing brightness uniformity of displayed image, comprising:

a processor configured to convert a frame of image data, which is divided into a first portion and a second portion based on that each sub-pixel in the first portion has an initial grayscale value smaller than that of each subpixel in the second portion, into N frames of image data;

wherein the apparatus is configured to receive the frame of image data comprising a plurality of initial grayscale values respectively corresponding to a plurality of sub-pixels;

wherein each sub-pixel in the first portion is provided with a first grayscale value in K of the N frames of image data and a second grayscale value in N-K of the N frames of image data; and each sub-pixel in the second portion is retained with its initial grayscale value in each of the N frames of image data, wherein N is an integer equal to or greater than 2 and K varies from 1 to N−1.

2. The apparatus of claim 1, further comprising a display panel configured to display a frame of image based on each of the N frames of image data according to a frame refreshing frequency.

3. The apparatus of claim 2, wherein the display panel is configured to provide a grayscale image based on each of the plurality of initial grayscale values that is smaller than a threshold grayscale value, a maximum brightness value of the grayscale image being measured by a camera; and the processor is configured to deduce a set of gamma curve data comprising a set of gamma-corrected brightness values corresponding to a set of grayscale values, the first grayscale value and the second grayscale value being two adjacent grayscale values corresponding to two gamma-corrected brightness values in the set of gamma curve data.

4. The apparatus of claim 3, wherein the processor is configured to select the first grayscale value, the second grayscale value, and a value of K so that a difference between a modified brightness value for sub-pixels in the first portion having a particular initial grayscale value and a superposition value of the two gamma-corrected brightness values respectively weighted with a first ratio of K/N and a second ratio of (N-K)/N is minimal.

5. The apparatus of claim 3, wherein the modified brightness value is equal to a maximum value among all sub-pixels corresponding to the particular initial grayscale value, multiplied by a factor.

6. The apparatus of claim 5, wherein the processor is configured to select a first value smaller than 1 as the factor to obtain a first value of the modified brightness value used in a first iteration of converting the frame of image data to the N frames of image data; and the display panel is configured to display a frame of image based on each of the N frames of image data which is subjected to a determination whether a brightness uniformity of a displayed frame of image meets a threshold uniformity.

7. The apparatus of claim 6, wherein the processor is configured to:

select a second value larger than the first value but still smaller than 1 as the factor to obtain a second value of the modified brightness value used in a second iteration of converting the frame of image data to the N frames of image data until the brightness uniformity of the displayed frame of image based on each of the N frames of images meets the threshold uniformity; and determine that the second value of the modified brightness value to be corresponding to the particular initial grayscale value.

8. The apparatus of claim 1, wherein N is selected to be equal to or smaller than 4.

9. The apparatus of claim 2, wherein the frame refreshing frequency is N×60 Hz.

10. A display apparatus comprising the apparatus of claim 1.

11. A method for displaying image using a display panel, the method comprising:

receiving a frame of image data comprising a plurality of initial grayscale values respectively corresponding to a plurality of sub-pixels; and converting the frame of image data, which is divided into a first portion and a second portion based on that each sub-pixel in the first portion has an initial grayscale value smaller than that of each subpixel in the second portion, into N frames of image data;

wherein each sub-pixel in the first portion is provided with a first grayscale value in K of the N frames of image data and a second grayscale value in N-K of the N frames of image data; and each sub-pixel in the second portion is retained with its initial grayscale value in each of the N frames of image data, wherein N is an integer equal to or greater than 2 and K varies from 1 to N−1.

12. The method of claim 11, further comprising displaying each of the N frames of images respectively based on the N frames of image data according to a frame refreshing frequency.

13. The method of claim 12, wherein the frame refreshing frequency is N×60 Hz.

14. The method of claim 11, comprising displaying a grayscale image of each of the initial grayscale values that are smaller than a threshold grayscale value to measure a corresponding maximum brightness value and to deduce a set of gamma curve data comprising a set of gamma-corrected brightness values corresponding to a set of grayscale values.

15. The method of claim 14, wherein the first grayscale value and the second grayscale value are two adjacent grayscale values corresponding to two gamma-corrected brightness values in the set of gamma curve data.

16. The method of claim 15, wherein the first grayscale value, the second grayscale value, and a value of K are selected so that a difference between a modified brightness value for all sub-pixels in the first portion having a particular initial grayscale value and a superposition value of the two gamma-corrected brightness values respectively weighted with a first ratio of KN and a second ratio of (N-K)/N is minimal.

17. The method of claim 16, wherein converting the frame of image data comprises determining the modified brightness value to be equal to a maximum brightness value among all sub-pixels corresponding to the particular initial grayscale value multiplied by a factor.

18. The method of claim 17, wherein converting the frame of image data further comprises:

selecting the factor smaller than 1 to calculate a first value of the modified brightness value used in a first iteration of converting the frame of image data to the N frames of image data;

displaying an image based on each of the N frames of image data; and determining whether a brightness uniformity of a displayed frame of image meets a threshold uniformity.

19. The method of claim 18, wherein converting the frame of image data further comprises:

increasing the factor to calculate a second value of the modified brightness value used in a second iteration of converting the frame of image data to the N frames of image data until the brightness uniformity of the displayed frame of image based on each of the N frames of images meets the threshold uniformity; and determining that the second value of the modified brightness value to be corresponding to the particular initial grayscale value.

20. The method of claim 11, wherein N is selected to be equal to or smaller than 4.

* * * * *